US005701244A

United States Patent [19]

Emmert et al.

[11] Patent Number: 5,701,244

[45] Date of Patent: Dec. 23, 1997

[54] UNINTERRUPTIBLE POWER SUPPLY

[75] Inventors: Steven C. Emmert, Crystal Lake; Louis J. Lundell, Buffalo Grove; Michael P. Murray, Chicago, all of Ill.

[73] Assignee: Motorola, Inc., Schaumburg, Ill.

[21] Appl. No.: 549,993

[22] Filed: Oct. 26, 1995

[51] Int. Cl.[6] ..... H01F 27/02

[52] U.S. Cl. ..... 363/146

[58] Field of Search ..... 336/61, 92, 105, 336/107, 198, 208; 307/64–66; 439/516; 363/146

[56] References Cited

U.S. PATENT DOCUMENTS 4,323,788 4/1982 Smith ..... 307/66

4,760,277 7/1988 Vurpillat ..... 307/64

5,244,411 9/1993 Schinke et al. ..... 439/516

5,272,459 12/1993 Geery ..... 336/107

*Primary Examiner*—Abitya Krishnan

*Attorney, Agent, or Firm*—John J. Oskorep; Donald C. Kordich

[57] ABSTRACT

An uninterruptible power supply (UPS) (100) has a housing (111) that supports the major electrical components of the UPS (100), i.e., a transformer circuit (207), a switching circuit (217), and a battery (209). Furthermore, a connector (107;115;117) affixed to the housing (111 ) is capable of removably affixing the UPS (100) to an alternating-current (AC) outlet (102).

9 Claims, 3 Drawing Sheets

UNINTERRUPTIBLE POWER SUPPLY

FIELD OF THE INVENTION

The present invention relates generally to the field of uninterruptible power supplies, and more particularly to AC-to-DC uninterruptible power supplies for electric appliances. Although the invention is subject to a wide range of applications, it is especially suited for use with a household alternating current (AC) outlet, and will be particularly described in that connection.

BACKGROUND OF THE INVENTION

Uninterruptible power supplies for electric appliances, e.g., base stations of cordless telephones, answering machines or desktop computers, are known in the art. Typically the conventional uninterruptible power supply (UPS) is housed in the electric appliance or, alternately, located physically apart from the electric appliance in its own enclosure.

When the electric appliance houses the UPS, this UPS consumes physical space, and the electric appliance's housing must accommodate the physical space required by the UPS. This causes the overall size of the electric appliance to increase. Whenever the electric appliance is meant to be set on a desktop and the occupied desk space is desired to be minimized, the increased size of the electric appliance is an undesirable consequence.

When the UPS is apart from the electric appliance, i.e., a stand-alone device, a first power cord running from the electric outlet to the UPS and a second power cord running from the UPS to the electric appliance is necessary. This type of UPS can be set on the floor and, if compact enough, on the desk. Typically, however, stand-alone UPS are not designed for desktop use because they supply large amounts of power, thus requiring bulky enclosures. If set on the floor, desk space is not consumed by the UPS, however, floor space is consumed by the UPS and the cords. Thus this UPS should be placed in an area that does not interfere with human traffic patterns.

A need therefore exists for an UPS that does not affect the size of the electric appliance, does not consume desk space, and reduces the possibility of interference with traffic patterns.

DETAILED DESCRIPTION OF THE PREFERRED EMBODIMENTS

The uninterruptible power supplies described herein provide advantages over known uninterruptible power supplies in that they allow for a compact design of the electric appliance and can be located out of the way of traffic patterns. Further, the herein described uninterruptible power supplies are capable of conveniently providing a UPS to electric appliances that do not have a UPS contained in the electric appliance, and therefore would not be able to have the feature of a backup power source otherwise. These advantages over conventional uninterruptible power supplies are principally provided by supporting or containing the major electrical components of the UPS in an integrally formed housing, and further mounting a connector to the housing that allows the UPS to be removably affixed to an alternating-current (AC) outlet.

Reference will now be made in detail to an embodiment configured according to the present invention.

Figure 1:
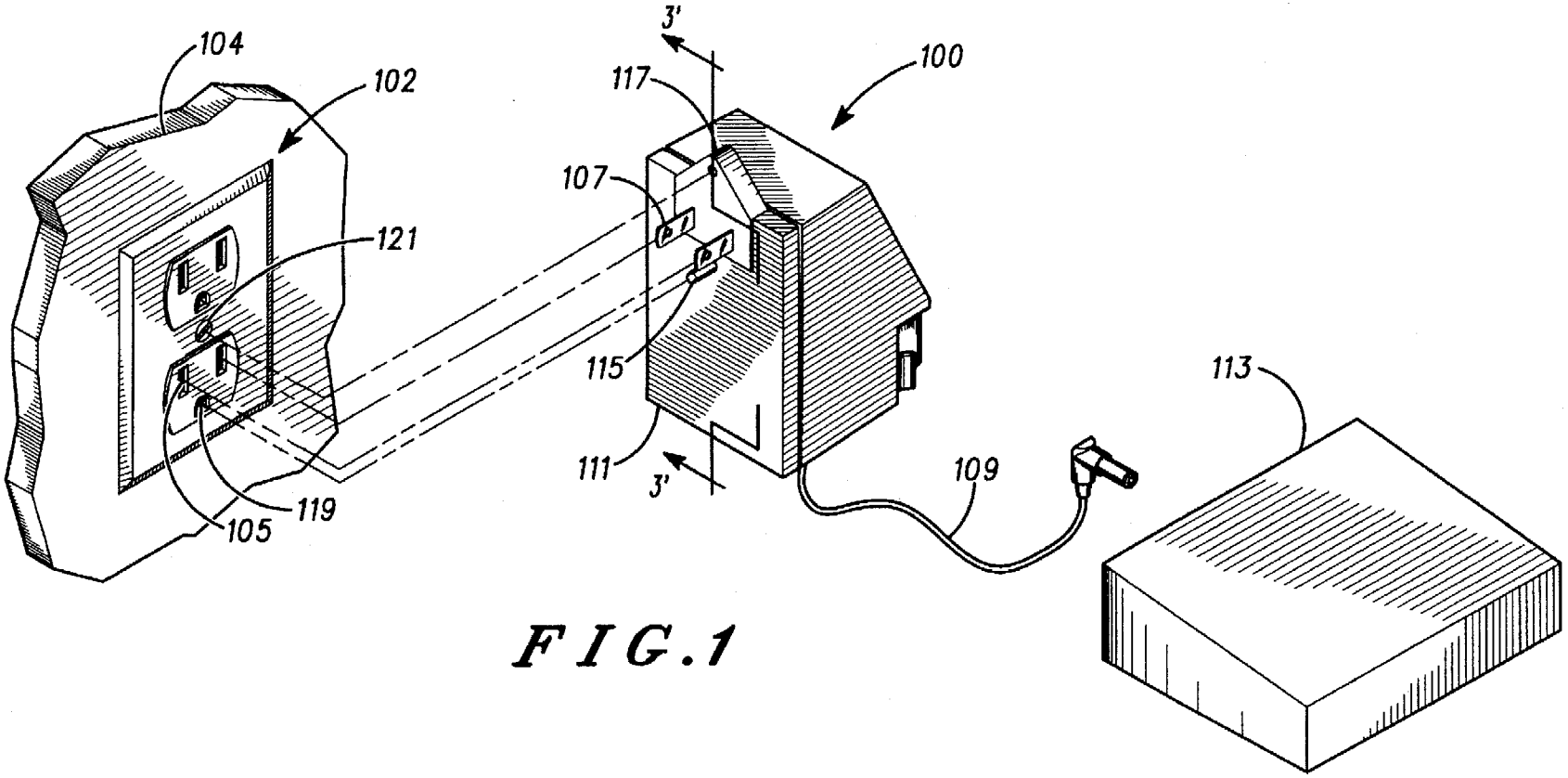
FIG. 1 is an isometric view of a UPS configured according to the present invention in a typical environment suitable for its use.

FIG. 1 illustrates a UPS 100 in a typical environment suited for its use. UPS 100 can be affixed to an alternating-current (AC) outlet 102 that is mounted on a wall 104. A power cord 109 extends from a housing 111 of UPS 100 to an electric appliance 113. Power cord 109 can be hard wired at one end to UPS 100, and the other end can terminate as a connector for coupling to electric appliance 113, or vice versa. Alternately, both ends could be hard wired or both ends could be terminated as a connector.

AC outlet 102 can be a common household electric outlet having contacts. For example, in the illustrated embodiment, the AC outlet's contacts are jacks 105 having slits for openings. An AC voltage, which can be variable and interruptible, can be supplied to the contacts from an electric mains.

UPS 100 has contacts affixed to housing 111 and are adapted for removably affixing to, and electrically coupling with, the electric outlet's contacts. For example, in the illustrated embodiment these contacts are shown as plugs 107 having a blade-like shape for insertion into the slit-shaped openings of jacks 105. Optionally, UPS 100 can have a post 115 adapted to removably affix to ground contact 119. Post 115 could be a ground plug associated with plugs 107, or could be an extension of housing 111 that is composed of nonconductive, hard plastic material. Or, UPS 100 can have a screw mount 117 that can be removably affixed to a threaded hole 121 of AC outlet 102 with a screw 221. Any one or any combination of plug 107, post 115, and screw mount 117 can be considered a connector of UPS 100 that is used to removably affix UPS 100 to AC outlet 102.

These features of locating the major electrical components of the UPS in a common housing and removably affixing the UPS to an AC outlet provide advantages over the prior art. For example, the UPS does not affect the size of the electric appliance because the UPS is remote from the electric appliance. Also, the UPS may not interfere with traffic patterns because the UPS is affixed to an AC outlet that is typically placed out of traffic patterns. Furthermore, an electric appliance that does not have a built-in UPS can be provided with a UPS that is compact.

Figure 2:
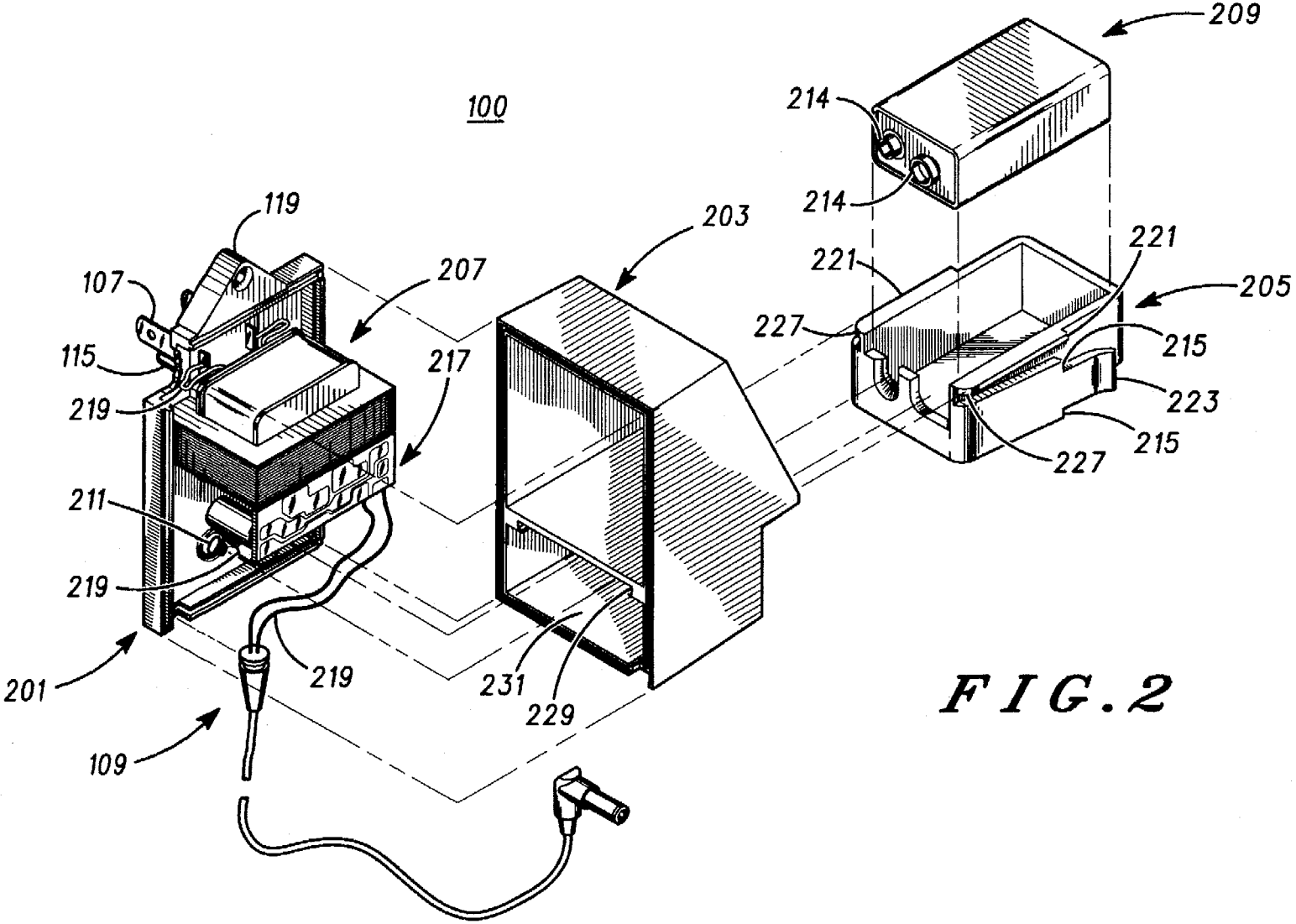
FIG. 2 is an exploded, isometric view of the UPS shown in FIG. 1.

FIG. 2 is an exploded, isometric view of UPS 100 illustrating the components constituting UPS 100. Housing 111, which contains some of the major electrical components of UPS 100, includes a housing base 201, a transformer housing 203, and a battery housing 205. The major electrical components of UPS 100 include a transformer circuit 207, a battery 209, a switching circuit 217, and a spring contact 211. Moreover, a plurality of lines or connecting wires 219 electrically connect components where necessary.

Transformer circuit 207 supplies a main source of DC power and is electrically coupled with plug 107. Transformer circuit 207 can be, e.g., a half-wave rectifier circuit. Battery 209 supplies a back-up source of DC power. In the illustrated embodiment, battery 209 is shown as a standard 9-volt alkaline battery. A switching circuit 217 is electrically coupled between transformer circuit 207 and battery 209, and provides a low-impedance path between battery 209 and transformer circuit 207 provided that the AC voltage is interrupted. Otherwise, switching circuit 217 provides a high-impedance path.

Figure 3:
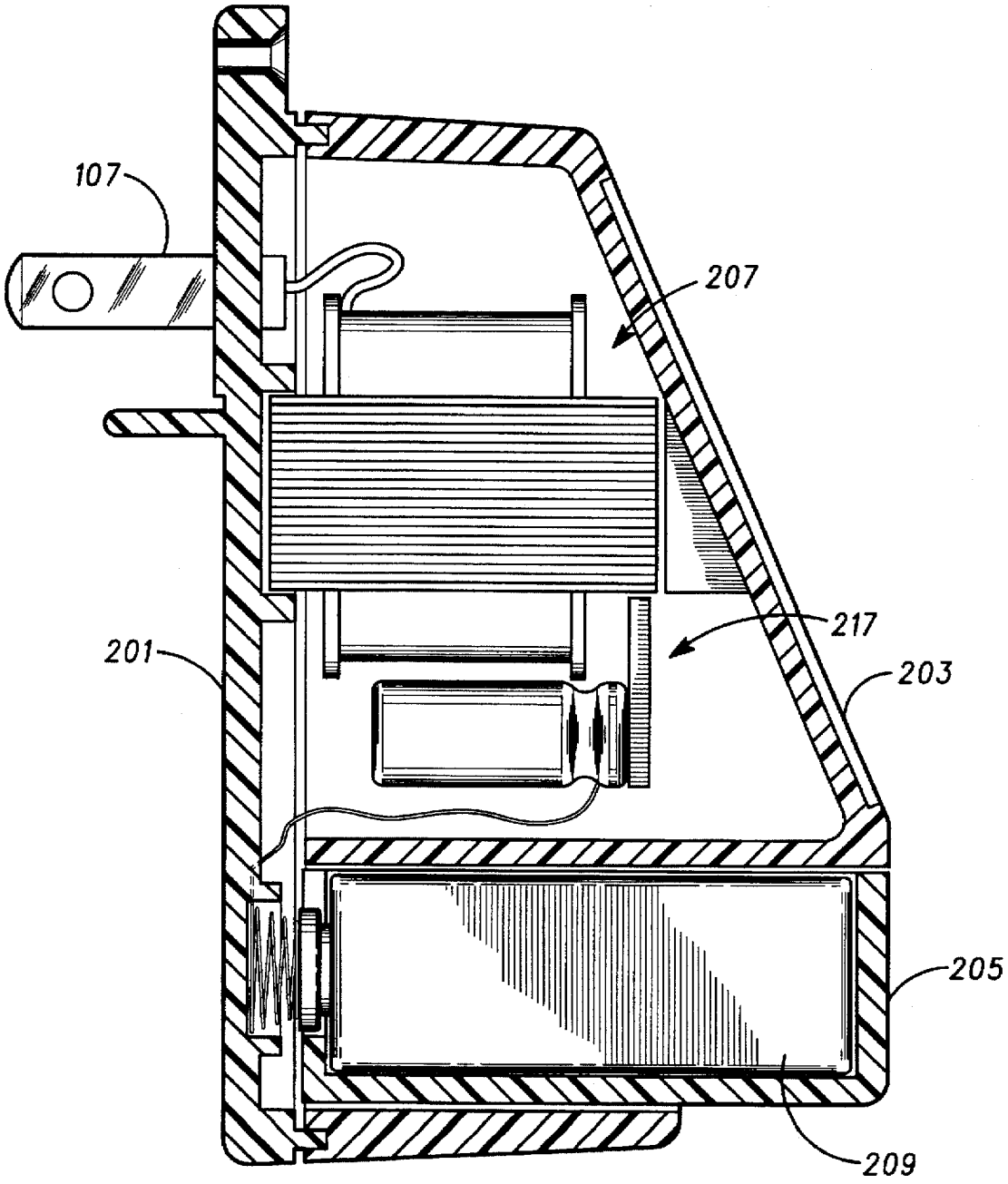
FIG. 3 is an offset section view of the assembled UPS shown in FIG. 1.

As shown in FIG. 3, which is an offset section view of the assembled UPS, housing base 201, transformer housing 203, and battery housing 205 are integrally formed such that when assembled they form a hollow enclosed unit for containing and supporting some of the electrical components. In this particular embodiment, transformer housing 203 is affixed to housing base 201 and is adapted for at least partially enclosing transformer circuit 207 and battery 209 when it is inserted. A cover, e.g., battery housing 205 in this described embodiment, is removably affixed to transformer housing 203 and provides access for removal of battery 209.

Transformer circuit 207 can be physically supported by housing 111 within the cavity formed by housing base 201 and transformer housing 203. For example, transformer circuit 207 can be fixedly attached to housing base 201 or compressively fitted between housing base 201 and transformer housing 203.

Further, battery housing 205 has a shape that is adapted to contain battery 209. Thus, battery 209 can be inserted into battery housing 205. The combined battery and battery housing is insertable into transformer housing 203 through an opening or compartment 231 in the lower back portion of transformer housing 203. (See FIG. 2.) The opening is adapted to support and partially enclose battery housing 205 with battery 209 installed.

Battery housing 205 has features that make it easy to install and remove battery 209 from UPS 100 without unplugging UPS 100 from AC outlet 102, and thus not interrupting the main source of DC power to the electric appliance. When fully inserted into compartment 231, the position of battery housing 205 is limited in the direction towards housing base 201 by the compressive force of spring contact 211, which can be mounted on housing base 201. In this position, terminals 214 of battery 209 make direct physical contact with spring contact 211, thus electrically coupling battery 209 with transformer circuit 207 by way of connecting wires 219.

Furthermore, as shown in FIG. 2, battery housing 205 has rails 221 with chamfers 227 for guiding battery housing 205 into the opening. The opening has slots 229 formed therein for receiving rails 221. Rails 221 are also used to suspend battery housing 205 in the opening.

Battery housing 205 also has snap catches 223 that are capable of exerting a force away from contained battery 209 when snap catches 223 are forced in a direction towards battery 209. Snap catches 223 have edges 215 formed thereon.

When battery housing 205 is fully inserted, snap catches 223 latch battery housing 205 to transformer housing 203. As battery housing 205 is inserted, snap catches 223 move towards contained battery 209 as the walls of the opening exert a force against snap catches 223. As battery housing 205 reaches its fully inserted position, edges 215 snap into place, under the force of snap catches 223, against stubs formed in the opening of transformer housing 203. The stubs exert a force on edges 215 that counteracts the spring force exerted upon terminals 214, thus latching battery housing 205 to transformer housing 203.

Battery 209 can be removed from transformer housing 203 without unplugging UPS 100. By compressing snap catches 223, which in turn release edges 215 from the stubs, battery housing 205 is unlatched from transformer housing 203. The spring force against terminals 214 assist in forcing battery housing 205 out of compartment 231.

Alternately, instead of the battery housing, the cover can be flat piece of material that fits over compartment 231, and is adapted to be removably affixed to transformer housing 203. This flat cover can be used to contain the battery in compartment 231, which is adapted for receiving the battery. The flat cover can be removed to provide access to the battery for removal.

Those skilled in the art will recognize that other modifications and variations than those previously described can be made in the UPS of the present invention, and in construction of this UPS, without departing from the scope or spirit of this invention. As examples, instead of a 9-volt alkaline and half-wave rectifier, a rechargeable battery, such as nickel-cadmium, can be used with a transformer circuit that is both a rectifier and a battery charger. A snap-on contact instead of a spring contact can be used to make electrical contact with the battery. Further, other types and numbers of batteries can be used, e.g., six, AA-size, nickel-cadmium battery cells. Of course the dimensions of the housing may require adjusting to accommodate the different battery sizes. Additionally, the contacts of the UPS can be of any standard or suitable shape and configuration for electrically coupling with the contacts of the AC outlet. For example, standard plug and jack configurations used in the United States and other countries can constitute the contacts. Also the AC outlet can be mounted on the floor or ceiling as well as the wall.

In summary, a UPS that is compactly contained in a housing and that is removably affixable to an AC outlet has been described that provides numerous advantages over the prior art uninterruptible power supplies.

What is claimed is:

1. An uninterruptible power supply (UPS) for supplying an uninterruptible direct-current power to an electric appliance having a housing frame, the UPS receiving alternating-current (AC) power from an AC outlet, the UPS comprising:

a transformer circuit for converting the AC power to a main source of DC power;

a battery for supplying a back-up source of DC power;

a switching circuit for electrically coupling the battery with the transformer circuit;

a housing physically supporting the switching circuit, the battery, and the transformer circuit, the housing being separate and apart from the housing frame; and a connector attached to the housing for attaching the UPS to the AC outlet.

2. The UPS of claim 1 wherein the housing includes:

a housing base, wherein the connector is fixedly attached thereto;

a transformer housing affixed to the housing base and for at least partially enclosing the switching circuit, the battery, and the transformer circuit; and a cover that is removably, affixable to the transformer housing for enclosing the battery and providing access to the battery for removal.

3. The UPS of claim 1, the AC outlet having first contacts, wherein the connector includes second contacts for attaching to the first contacts and electrically coupled with the transformer circuit.

4. The UPS of claim 1, wherein the connector includes a post.

5. The UPS of claim 1, wherein the connector includes a screw mount.

6. An uninterruptible power supply (UPS) for supplying an uninterruptible direct-current power to an electric appliance having a housing frame, wherein an alternating-current (AC) outlet has first contacts providing an interruptible AC voltage, the UPS comprising:

second contacts capable for electrically coupling with the first contacts;

a transformer circuit coupled with the second contacts;

a battery;

a switching circuit, coupled between the battery and the transformer circuit, for providing a low-impedance path between the battery and the transformer circuit provided that the AC voltage is interrupted and a high-impedance path otherwise; and a housing supporting the transformer circuit, the battery, and the switching circuit, the housing being separate and apart from the housing frame, and the second contacts are mounted to the housing.

7. The UPS of claim 6 wherein the first contacts are jacks and the second contacts are plugs.

8. Stand-alone uninterruptible power supply (UPS) for attaching to an alternating-current (AC) outlet, the UPS comprising:

a housing base;

contacts affixed to the housing base for electrically coupling with the AC outlet;

a transformer housing integrally formed to attach to the housing base and having a compartment formed therein;

a transformer circuit supported within the housing base and transformer housing, electrically coupled with the contacts, and for supplying a main source of DC power;

a battery for supplying a back-up source of DC power, electrically coupled with the transformer circuit, wherein the compartment is adapted to receive the battery; and a cover attached to the transformer housing for containing the battery in the compartment.

9. The UPS of claim 8, wherein the battery is capable of being removed from the transformer housing while the contacts are electrically coupled with the AC outlet, thus not interrupting the main source of DC power when the battery is removed.

* * * * *